US012550967B2

(12) United States Patent
Kroes et al.

(10) Patent No.: US 12,550,967 B2
(45) Date of Patent: Feb. 17, 2026

(54) ADJUSTABLE SHOE

(71) Applicant: BECAUSE INTERNATIONAL, CORP., Nampa, ID (US)

(72) Inventors: Andrew Kroes, Nampa, ID (US); Joel Rusnak, Newburyport, MA (US)

(73) Assignee: BECAUSE INTERNATIONAL, CORP., Nampa, ID (US)

( * ) Notice: Subject to any disclaimer, the term of this patent is extended or adjusted under 35 U.S.C. 154(b) by 0 days.

(21) Appl. No.: 18/774,218

(22) Filed: Jul. 16, 2024

(65) Prior Publication Data

US 2026/0020635 A1 Jan. 22, 2026

(51) Int. Cl.
*A43B 3/12* (2006.01)
*A43B 3/26* (2006.01)

(52) U.S. Cl.
CPC ..... *A43B 3/126* (2013.01); *A43B 3/12* (2013.01); *A43B 3/128* (2013.01); *A43B 3/26* (2013.01)

(58) Field of Classification Search
CPC ..... A43B 3/12; A43B 3/122; A43B 3/124; A43B 3/126
USPC ..... 36/11.5
See application file for complete search history.

(56) References Cited

U.S. PATENT DOCUMENTS

D83,898 S 4/1931 Golden
1,805,728 A * 5/1931 Sohn ..... A43B 3/124 36/11
1,894,561 A * 1/1933 Guiffre ..... A43B 3/124 36/11
2,062,909 A * 12/1936 Kenagy, Sr. ..... A43B 3/124 D2/919
2,072,785 A * 3/1937 Wulff ..... A43B 3/128 36/11.5
2,108,849 A * 2/1938 Engel ..... A43B 3/124 36/19 R
2,169,337 A * 8/1939 Davis ..... A43B 3/124 36/11.5
2,193,943 A * 3/1940 Shea ..... A43B 3/124 36/11.5
2,206,001 A 6/1940 Cohen
2,220,534 A * 11/1940 McLean ..... A43B 3/124 36/11.5

(Continued)

OTHER PUBLICATIONS

Because International Facebook post, Image, Dec. 20, 2013.

(Continued)

*Primary Examiner* — Marie D Bays
(74) *Attorney, Agent, or Firm* — PRICE HENEVELD LLP

(57) ABSTRACT

An adjustable shoe for accommodating a range of shoe sizes includes a sole, a medial flap extending upwardly and at least partially over the sole, a lateral flap extending upwardly and at least partially over the sole, and a toe cap extending upwardly and partially over the sole. A connecting strap disposed on the medial flap or the lateral flap is adjustably connected to the other of the lateral flap or the medial flap, respectively. An adjustable heel strap is connected to the medial flap and the lateral flap and extends around the heel end of the sole. One of the medial flap or the lateral flap are adapted to overlap the other of the lateral flap or the medial flap, respectively, and the toe cap is adjustably connected at a distal end thereof to one or both of the medial flap and/or the lateral flap.

18 Claims, 10 Drawing Sheets

(56) References Cited

U.S. PATENT DOCUMENTS 2,239,206 A * 4/1941 Tietig ..... A43B 3/124 36/154
2,391,720 A * 12/1945 Ludwig ..... A43B 3/26 36/97
2,421,818 A 6/1947 Tibletti
D147,311 S 8/1947 Veach
2,444,822 A 7/1948 Griffin
D150,568 S 8/1948 Griffin
D156,604 S 12/1949 Codish
2,513,005 A * 6/1950 Crawford ..... A43B 3/12 D2/919
D165,116 S 11/1951 Sloan et al.
2,588,061 A 3/1952 Karel
D166,785 S 5/1952 Wiseman
2,603,889 A * 7/1952 Lahnstein ..... A43C 11/02 36/97
2,630,636 A 3/1953 Cockrell
2,773,317 A * 12/1956 Helle ..... A43B 3/122 36/11.5
3,057,086 A * 10/1962 Rigsby ..... A43B 3/26 36/97
3,058,241 A * 10/1962 Rigsby ..... A43B 3/30 36/97
3,063,167 A * 11/1962 Scholl ..... A43B 3/103 36/11.5
D235,591 S * 7/1975 Huff ..... D2/900
4,275,512 A * 6/1981 Zeligman ..... A43B 3/124 36/43
5,423,134 A 6/1995 Bagnaia et al.
5,452,527 A * 9/1995 Gaylord, Jr. ..... A61F 5/0195 36/110
D379,709 S 6/1997 Francis et al.
5,836,090 A 11/1998 Smith
5,896,677 A * 4/1999 Barsorian ..... A43B 17/08 36/43
5,991,950 A * 11/1999 Schenkel ..... A43B 3/122 36/23
6,052,920 A * 4/2000 Bathum ..... A43B 3/0052 36/114
6,212,798 B1 * 4/2001 Koenig ..... A61F 5/0195 36/110
D459,862 S 7/2002 Butler et al.
6,493,965 B1 12/2002 Bathum
6,848,202 B2 * 2/2005 Berggren ..... A43B 3/242 36/97
7,055,265 B1 6/2006 Bathum et al.
7,121,020 B1 10/2006 Bathum
7,222,440 B2 5/2007 Dombowsky
7,788,827 B2 9/2010 Fogg et al.
7,926,151 B1 * 4/2011 MacWilliam ..... A44B 11/24 24/178
10,390,585 B2 8/2019 Lee et al.
12,089,696 B1 * 9/2024 Bar ..... A43B 11/02
2002/0007570 A1 1/2002 Girard
2003/0182820 A1 10/2003 Fuerst et al.
2006/0059712 A1 * 3/2006 Asham ..... A43B 17/10 36/11.5
2006/0288610 A1 12/2006 Laska et al.
2017/0360144 A1 * 12/2017 Lee ..... A43B 23/0295

OTHER PUBLICATIONS

Because International Facebook post, Shared Article from Idaho Press-Tribune, "Donate pair of shoes through Idaho Gives," Apr. 30, 2014.

* cited by examiner

ADJUSTABLE SHOE

BACKGROUND OF THE INVENTION

The present invention relates to an article of footwear, and, in particular, to an adjustable shoe that is adjustable through a range of shoe sizes.

SUMMARY OF THE INVENTION

The present disclosure presents an adjustable shoe for accommodating a range of shoe sizes and which can be modified by the wearer, such as child, to compensate for the growth of the wearer over time to provide a comfortable and appropriate fit of the wearer's feet within the adjustable shoe.

One aspect of the present disclosure is an article of footwear comprising a sole having a toe end, a medial side, a lateral side, and a heel end; a medial flap extending from the medial side of the sole and adapted to wrap upwardly and at least partially over the sole in the direction of the lateral side; a lateral flap extending from the lateral side of the sole and adapted to wrap upwardly and at least partially over the sole in the direction of the medial side; a toe cap extending from the toe end of the sole and adapted to wrap upwardly and partially over the sole in the direction of the heel end; a connecting strap disposed on the medial flap or the lateral flap and adjustably connected to the other of the lateral flap or the medial flap, respectively. An adjustable heel strap is connected to the medial flap and the lateral flap and extends around the heel end of the sole. One of the medial flap or the lateral flap are adapted to overlap the other of the lateral flap or the medial flap, respectively, and the toe cap is adjustably connected at a distal end thereof to one or both of the medial flap and/or the lateral flap.

Another aspect of the present disclosure is an article of footwear comprising a sole having a toe end, a medial side, a lateral side, and heel end; a medial flap, a lateral flap, and a toe cap each disposed as integral extensions of the sole, the toe cap having a distal end with a fastener mounting hole; and a plurality of longitudinally spaced and aligned holes through each of the medial flap and the lateral flap, wherein the plurality of longitudinally spaced and aligned holes through the medial flap or the lateral flap are adapted to selectively overlap a corresponding plurality of longitudinally spaced and aligned holes through the other of the lateral flap or medial flap, respectively, and a toe fastener on a distal end of the toe cap is adapted to extend through at least one of the plurality of longitudinally spaced and aligned holes of one or both of the medial flap and the lateral flap. A plurality of connecting straps is adjustably connected to the medial flap with the lateral flap. An adjustable heel strap is adjustably connected to the medial flap and the lateral flap and extends around the heel end of the sole.

A further aspect of the present disclosure is an article of footwear comprising a sole having a toe end, a medial side, a lateral side, and a heel end; an integral medial flap extending from the medial side of the sole and adapted to wrap upwardly and at least partially over the sole in the direction of the lateral side, the medial flap having a plurality of longitudinally spaced and aligned holes, including a single primary row of plurality of longitudinally spaced and aligned holes; an integral lateral flap extending from the lateral side of the sole and adapted to wrap upwardly and at least partially over the sole in the direction of the medial side, the lateral flap having a plurality of rows of a plurality of longitudinally spaced and aligned holes, wherein one of the rows of the plurality of longitudinally spaced and aligned holes through the lateral flap is adapted to selectively overlap the plurality of longitudinally spaced and aligned holes through the medial flap; and an integral toe cap extending from the toe end of the sole and adapted to wrap upwardly and partially over the sole in the direction of the heel end, wherein a toe fastener on the distal end of the toe cap is adapted to extend through at least one of the single primary row of plurality of longitudinally spaced and aligned holes of the medial flap and/or at least one of the plurality of longitudinally spaced and aligned holes of one or both of the medial flap and the lateral flap. A pair of connecting straps is disposed on the medial flap and a pair of buckles disposed on the lateral flap, wherein the pair of connecting straps each further comprises a plurality of longitudinally spaced and aligned holes within which a prong of one of the buckles may be selectively inserted to adjustably secure the connecting straps to the lateral flap and thereby adjustably secure the medial flap and lateral flap one to the other. An adjustable heel strap is connected to the medial flap and the lateral flap and extends around the heel end of the sole, wherein the adjustable heel strap further comprises a mounting hole at a first end through which a fastener extends to attach the adjustable heel strap to one of the lateral flap or medial flap and a plurality of longitudinally spaced and aligned holes at a second end thereof within which a prong of a heel buckle disposed on the other of the medial flap or the lateral flap may be selectively inserted to adjustably secure the second end of the adjustable heel strap to the other of the medial flap or lateral flap.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
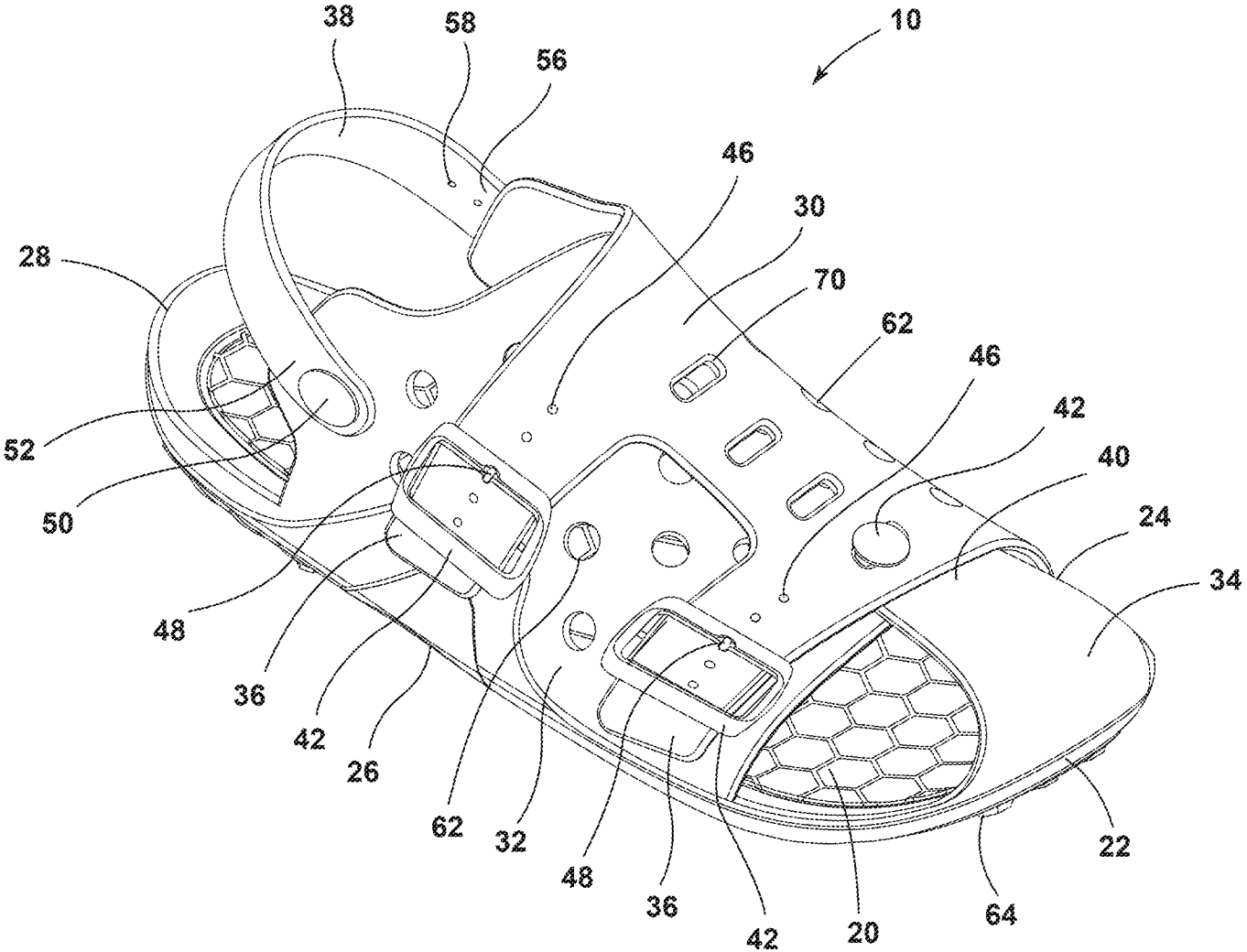
FIG. 1 is a front top perspective view of the article of footwear.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. Further, to provide clarity, like structures amongst the various embodiments disclosed herein are referred to by common reference numbers.

FIGS. 1-10 show a basic embodiment of an adjustable shoe 10 for accommodating a range of shoe sizes and which can be modified by the wearer, such as child, to compensate for the growth of the wearer over time to provide a comfortable and appropriate fit of the wearer's feet within the adjustable shoe 10. It should be understood that the adjustable shoe 10 may be formed in varying sizes to accommodate children of different age ranges and sizes, yet still provide an adjustable shoe 10 that may be used by the wearer throughout the useful life of the adjustable shoe 10.

Adjustable shoe 10, also referred hereinto as an article of footwear, includes a sole 20 having a toe end, 22 a medial side 24, a lateral side 26, and a heel end 28. A medial flap 30 may extend from the medial side 24 of the sole 20 and may be adapted to wrap upwardly and at least partially over the sole 20 in the direction of the lateral side 26. A lateral flap 32 may extend from the lateral side 26 of the sole 20 and may be adapted to wrap upwardly and at least partially over the sole 20 in the direction of the medial side 24. A toe cap 34 may extend from the toe end 22 of the sole 20 and may be adapted to wrap upwardly and partially over the sole 20 in the direction of the heel end 28.

Figure 10:
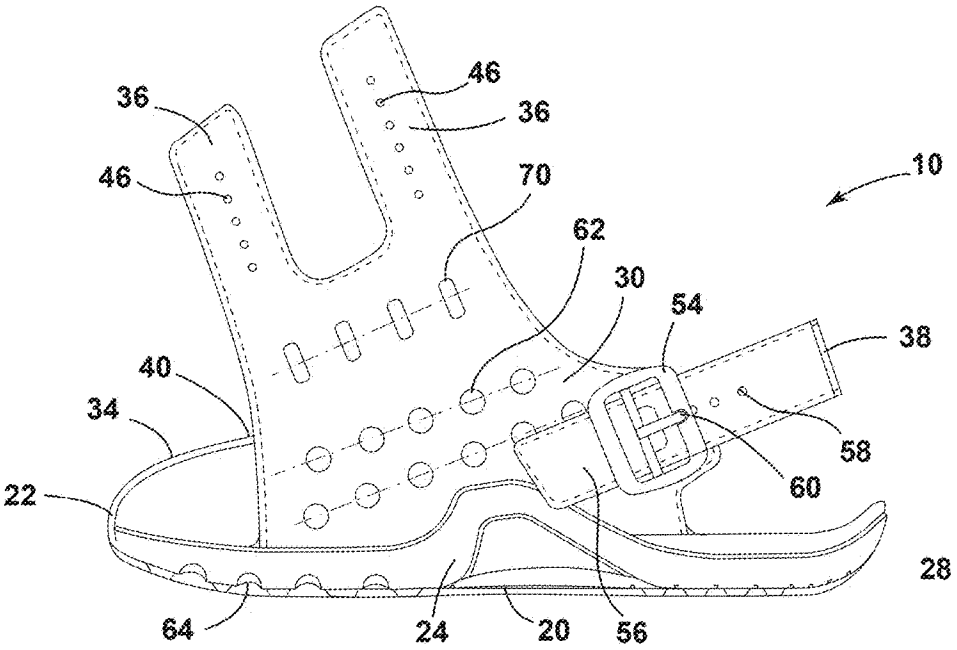
FIG. 10 is a second side view of the article of footwear disclosed in FIG. 1, with the lateral flap extended.

A connecting strap 36 may be disposed on the medial flap 30 or the lateral flap 32 and may be adjustably connected to the other of the lateral flap 32 or the medial flap 30, respectively. An adjustable heel strap 38 may be connected to the medial flap 30 and the lateral flap 32 and extend around the heel end 28 of the sole 20. As shown in the Figures, one of the medial flap 30 or the lateral flap 32 are adapted to overlap the other of the lateral flap 32 or the medial flap 30, respectively, and the toe cap 34 is adjustably connected at a distal end 40 thereof to one or both of the medial flap 30 and/or the lateral flap 32 via a fastener 42, as shown in FIG. 10, fixedly disposed through the distal end 40 of the toe cap 34.

The medial flap 30, the lateral flap 32, and the toe cap 34 may each be configured as integral extensions of the sole 20. That is, sole 20, the medial flap 30, the lateral flap 32, and the toe cap 34 may be fabricated via an injection molding process as a single unitary structure comprised of a polymeric material, such as a blend of rubber and PVC (polyvinyl chloride).

Figure 3:
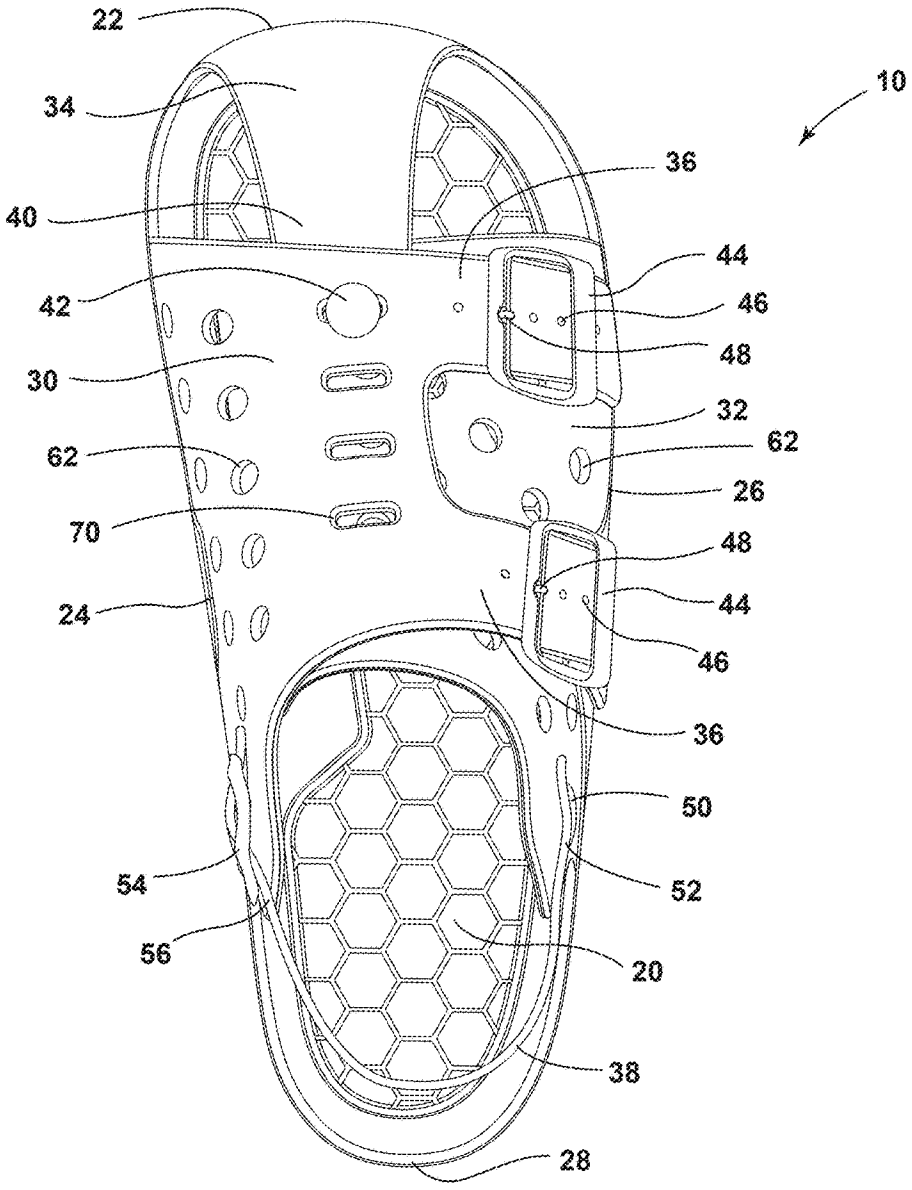
FIG. 3 is a top plan view of the article of footwear disclosed in FIG. 1.
Figure 4:
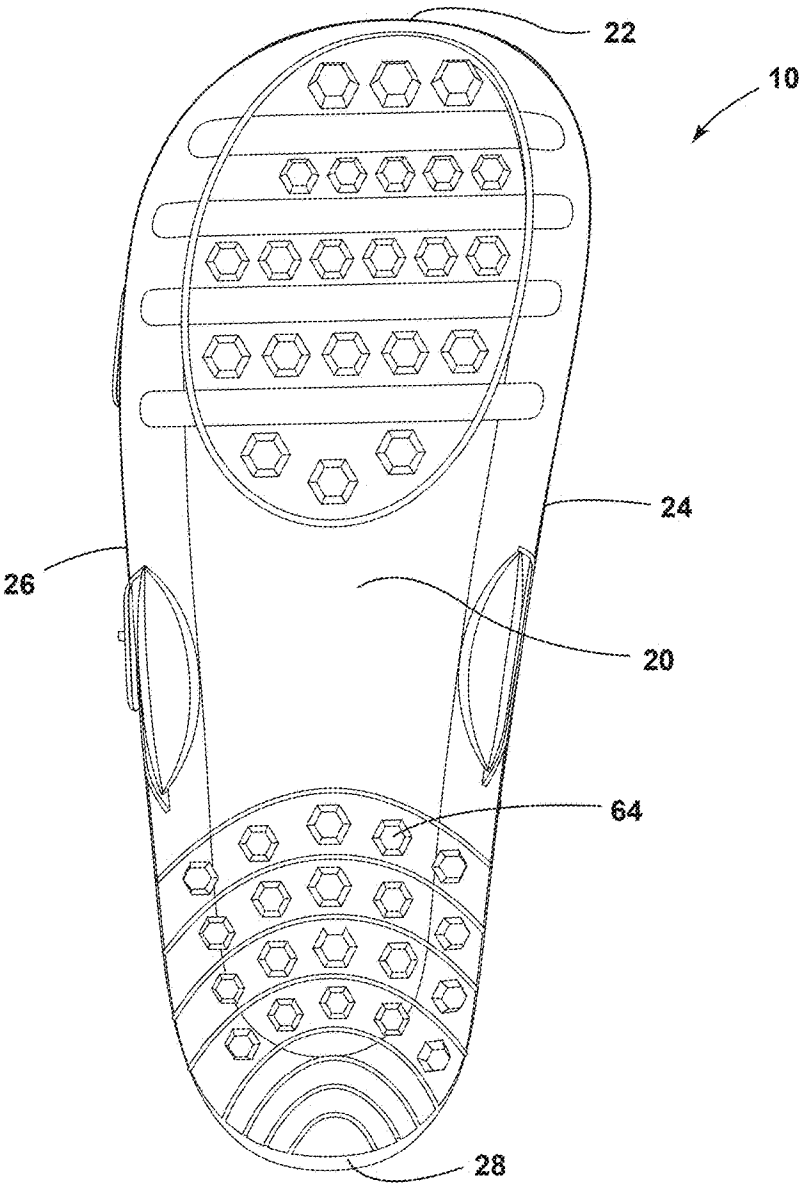
FIG. 4 is a bottom plan view of the article of footwear disclosed in FIG. 1.
Figure 5:
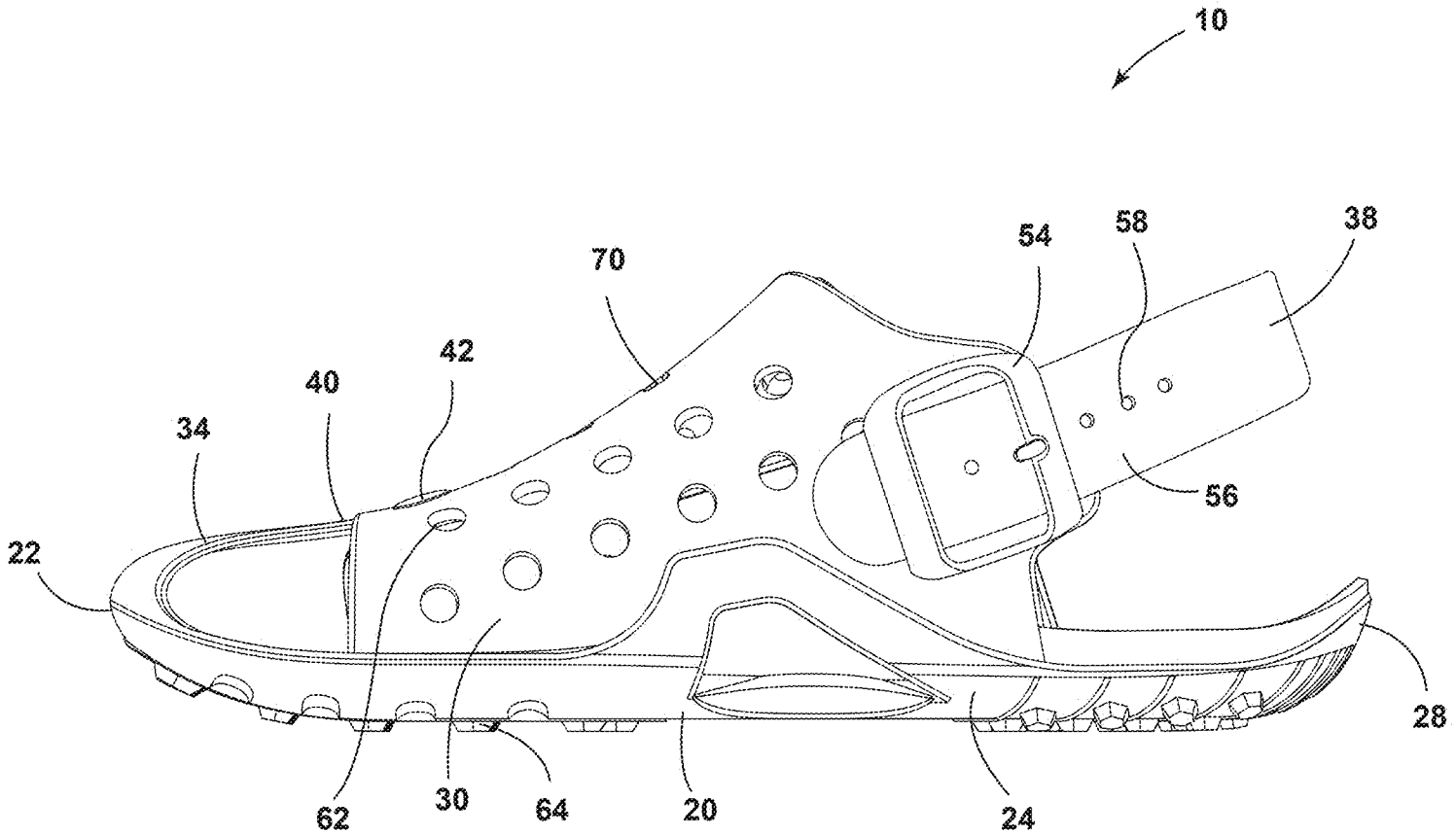
FIG. 5 is a first side plan view of the article of footwear disclosed in FIG. 1.
Figure 6:
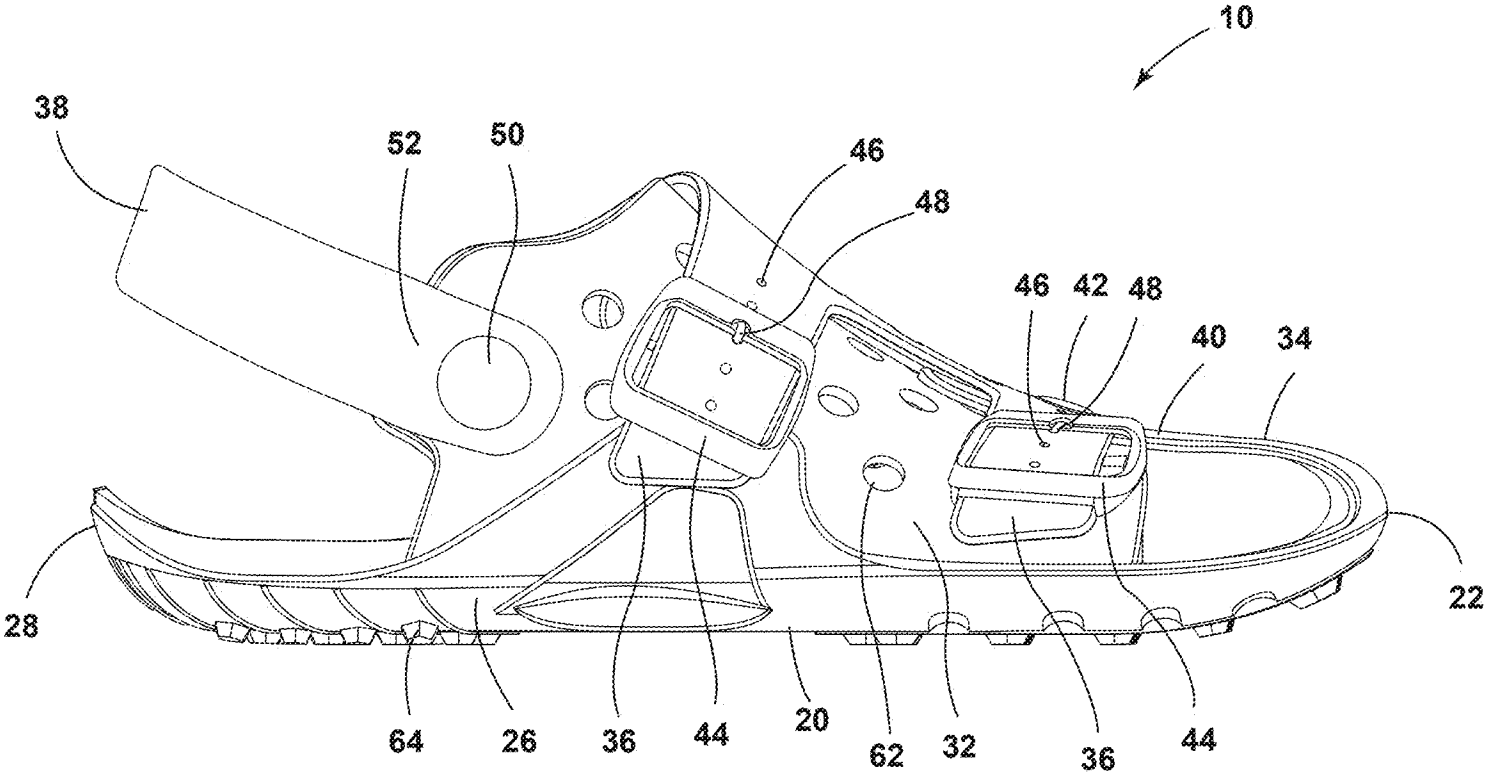
FIG. 6 is a second side plan view of the article of footwear disclosed in FIG. 1.
Figure 7:
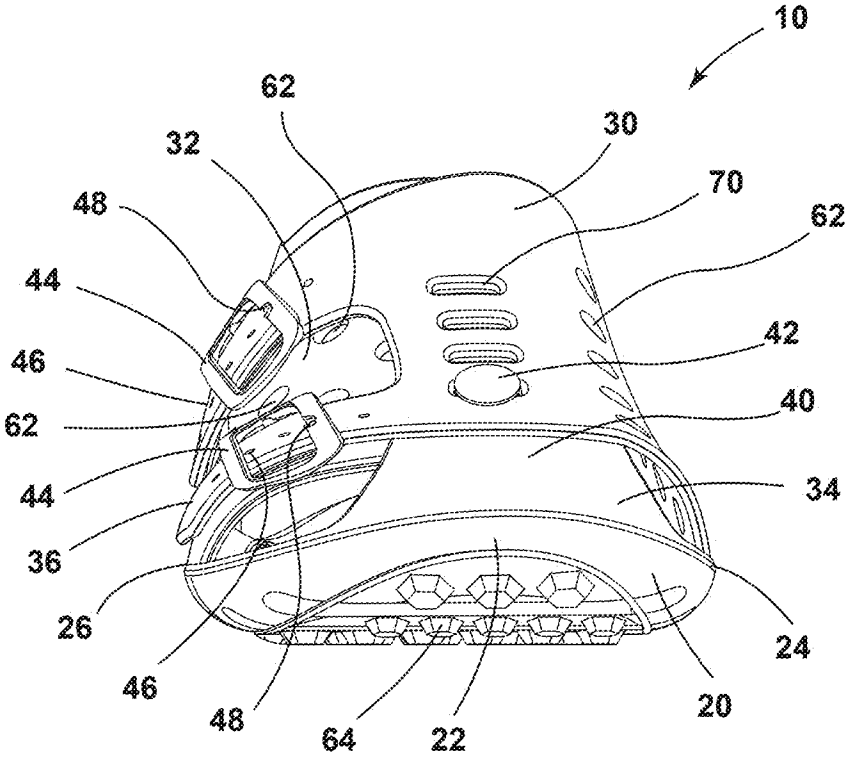
FIG. 7 is a front plan view of the article of footwear disclosed in FIG. 1.
Figure 8:
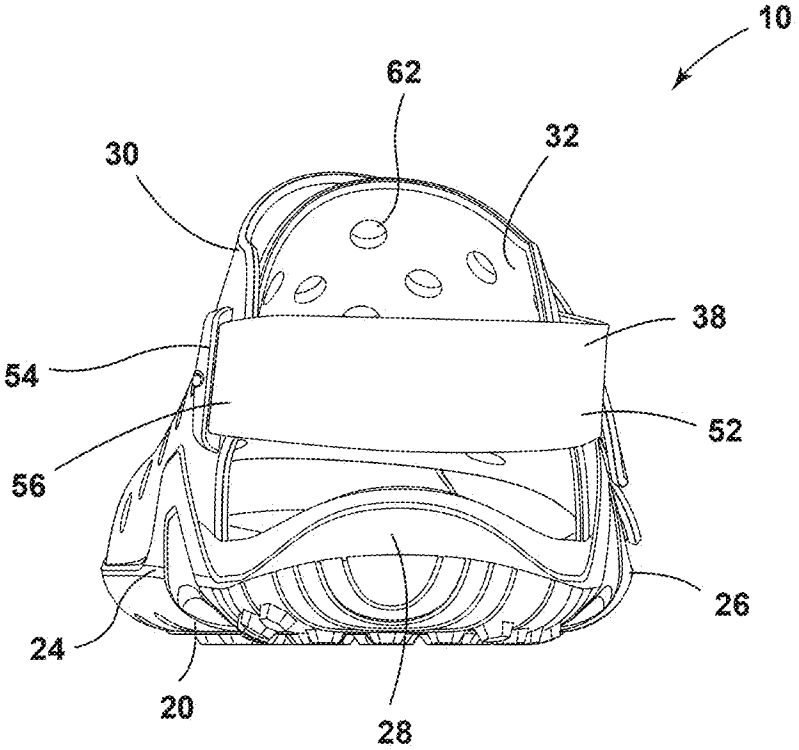
FIG. 8 is a rear plan view of the article of footwear disclosed in FIG. 1.
Figure 9:
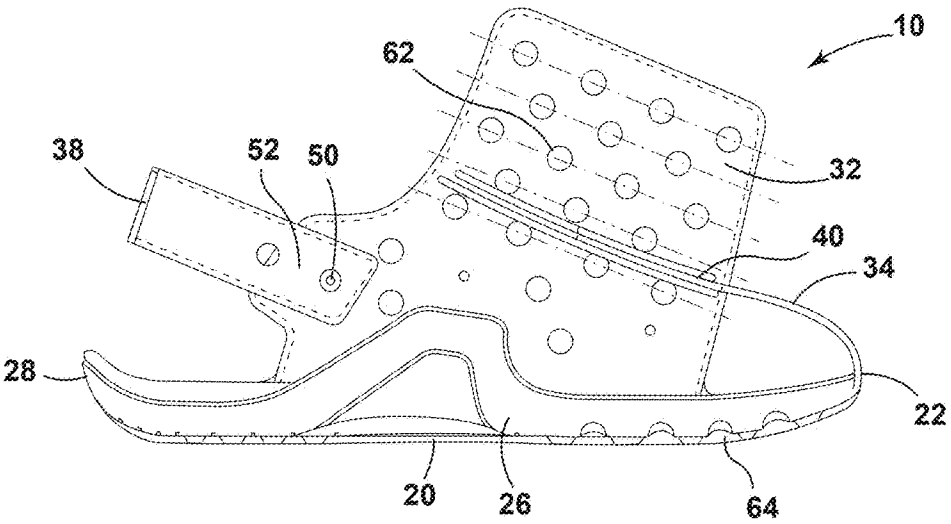
FIG. 9 is a first side view of the article of footwear disclosed in FIG. 1, with the medial flap extended.

The connecting strap 36 disposed on one of the medial flap 30 or the lateral flap 32 may be adjustably connected to the other of the lateral flap 32 or the medial flap 30, respectively, with a fastening device. In one embodiment of the adjustable shoe 10, the fastening device may be a flap buckle 44 mounted to the other of the lateral flap 32 or medial flap 30. As shown in FIGS. 1 and 3, the connecting strap 36 may also include a plurality of longitudinally spaced and aligned holes 46 within which a prong 48 of the flap buckle 44 may be selectively inserted to adjustably secure the connecting strap 36 to the other of the lateral flap 32 or medial flap 30 and thereby adjustably secure the one of the medial flap 30 or the lateral flap 32 to the other of the lateral flap 32 or medial flap 30, respectively.

As further shown in FIGS. 1 and 3, in one embodiment, a pair of connecting straps 36 may be disposed on the one of the medial flap 30 or the lateral flap 32 and a pair of flap buckles 44 may be disposed on the other of the lateral flap 32 or medial flap 30, respectively, wherein the pair of connecting straps 36 may be each adjustably connected to the other of the lateral flap 32 or the medial flap 30, respectively, with one of the pair of flap buckles 44. The pair of connecting straps 36 may each further comprise the plurality of longitudinally spaced and aligned holes 46 within which a prong 48 of one of the pair of flap buckles 44 may be selectively inserted to adjustably secure the pair of connecting straps 36 to the other of the lateral flap 32 or medial flap 30 and thereby adjustably secure the medial flap 30 or the lateral flap 32 to the other of the lateral flap 32 or medial flap 30, respectively.

Figure 11B:
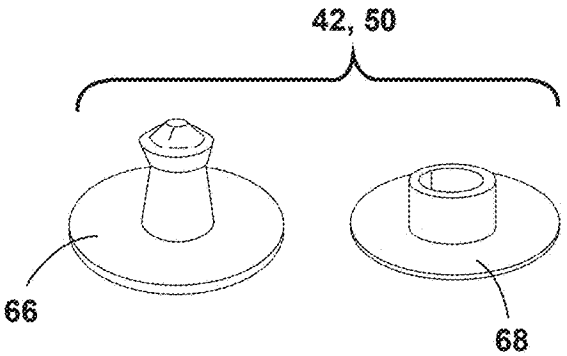
FIG. 11B is a perspective view of the disassembled heel strap fastener of the article of footwear disclosed in FIG. 1.
Figure 11A:
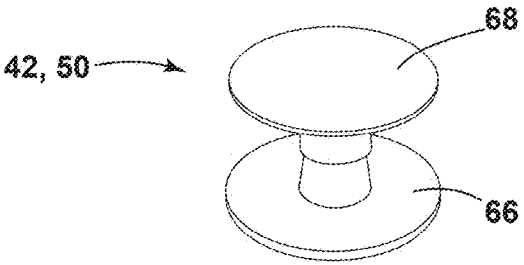
FIG. 11A is a perspective view of the assembled heel strap fastener of the article of footwear disclosed in FIG. 1.
Figure 12:
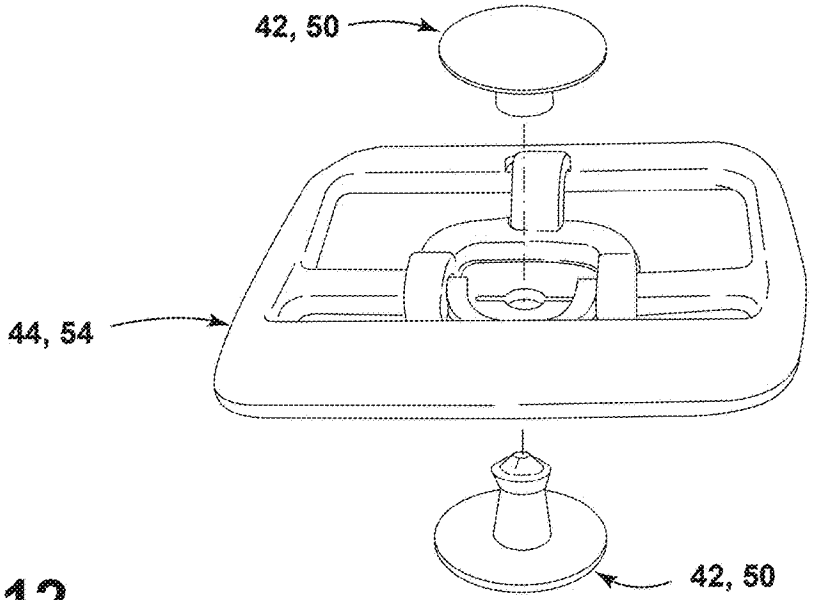
FIG. 12 is a perspective view of the buckle and the toe cap fastener of the article of footwear disclosed in FIG. 1.

A first fastener 50 may be disposed on one of the lateral flap 32 or the medial flap 30 to which a proximal end 52 of the heel strap 38 may be secured and a second fastener 54 may be disposed on the other of the medial flap 30 or lateral flap 32 to which a distal end 56 of the heel strap 38 may be adjustably secured. The first fastener 50 may be a detachable button, as shown in FIGS. 11A and 11B, and the second fastener 54 may be configured as a heel buckle, as shown in FIG. 10. The heel strap 38 may be provided with a plurality of longitudinally spaced and aligned holes 58 within which a prong 60 of the heel buckle 54 may be selectively inserted to adjustably secure the distal end 56 of the heel strap 38 to the other of the medial flap 30 or lateral flap 32. The heel strap 38 is thus adjustably connected to the medial flap 30 and the lateral flap 32 and extends around the heel end 28 of the sole 20.

The toe cap 34 may be adjustably connected to one or both of the medial flap 30 and/or the lateral flap 32 by the toe fastener 42, shown in FIG. 10. One or both of the medial flap 30 and/or the lateral flap 32 may include a plurality of longitudinally spaced and aligned holes 62, as shown in FIGS. 1 and 3, and the toe fastener 42 may be adapted to extend from the distal end 40 of the toe cap 34 and may be adapted to engage with at least one of the plurality of longitudinally spaced and aligned holes 62 through one or both of the medial flap 30 and/or the lateral flap 32. As shown, the medial flap 30 is provided with a single primary row of plurality of longitudinally spaced and aligned holes 70 through which the toe fastener 42 extends to affix the toe cap 34 to the medial flap 70.

In addition, one of the medial flap 30 or the lateral flap 32 may further include a plurality of rows of the plurality of longitudinally spaced and aligned holes 62, as shown in FIGS. 1 and 3, that are adapted to selectively overlap a corresponding one row of the plurality of longitudinally spaced and aligned holes 62 through the other of the lateral flap 32 or medial flap 30, respectively. The toe fastener 42 may be adapted to extend through at least one of the plurality of longitudinally spaced and aligned holes 62 that overlap one another and through each of the medial flap 30 and the lateral flap 32.

Figure 2:
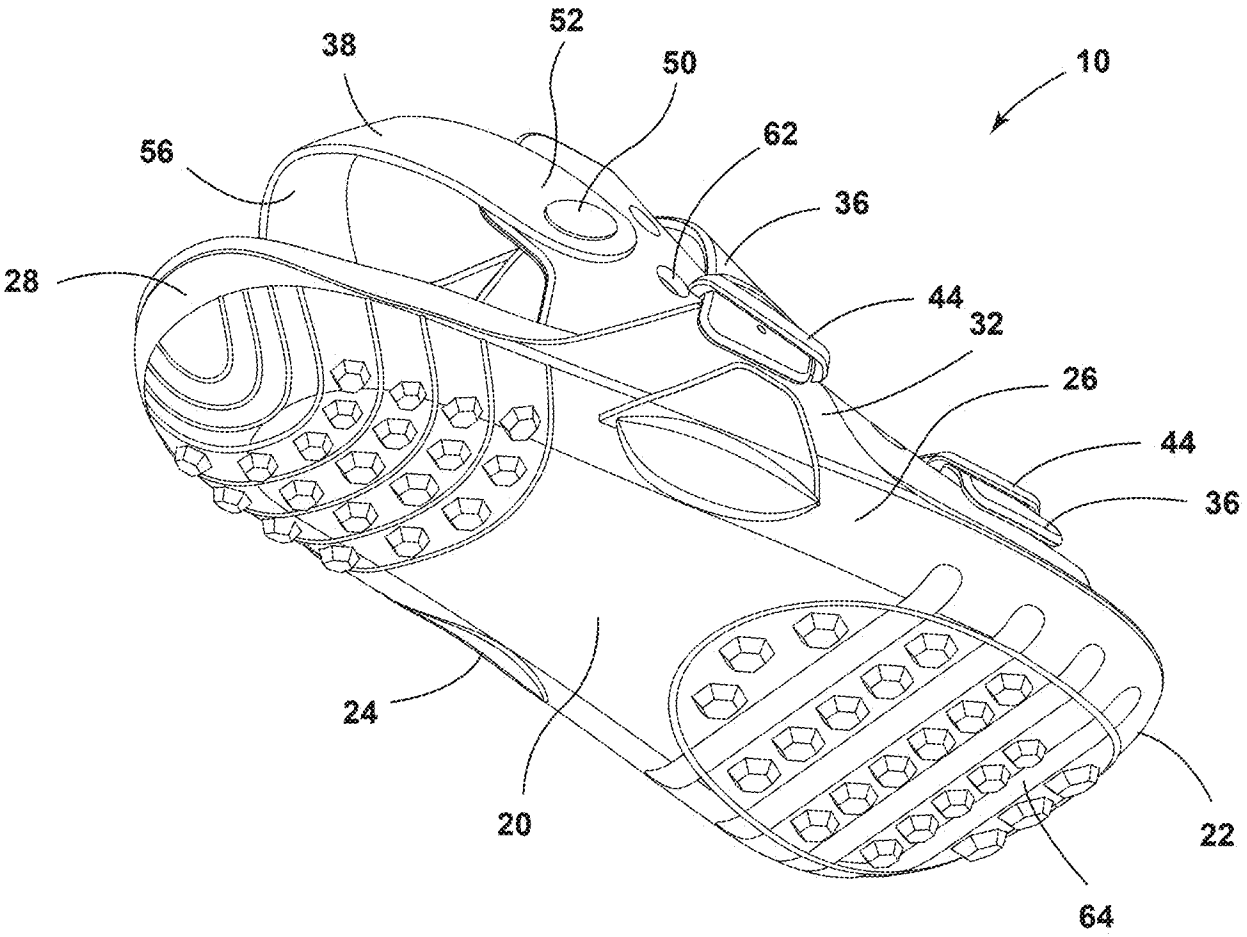
FIG. 2 is a bottom rear perspective view of the article of footwear disclosed in FIG. 1.

As shown in FIG. 2, the sole 20 of the adjustable shoe 10 may include an outsole 64. As can therein be seen, the outsole 64 may extend onto the medial flap 30, the lateral flap 32, and the toe cap 34, thereby providing an adjustable outsole size.

As shown in FIGS. 1-10, adjustable shoe 10 may include the sole 20 having the toe end 22, the medial side 24, the lateral side 26, and the heel end 28. The integral medial flap 30 may extend from the medial side 24 of the sole 20 and may be adapted to wrap upwardly and at least partially over the sole 20 in the direction of the lateral side 26. As shown, the medial flap 30 may also have a single primary row of plurality of longitudinally spaced and aligned holes 70. The amount of upward wrap and partial overlay of the medial flap with the sole 20 may allow for and provide one adjustment of the shoe size of the adjustable shoe 10.

The integral lateral flap 30 may extend from the lateral side 26 of the sole 20 and may be adapted to wrap upwardly and at least partially over the sole 20 in the direction of the medial side 24. As shown in FIGS. 1 and 3, the medial flap 30 wraps over and overlays the lateral strap 32. Further, the lateral flap 32 may have a plurality of rows of the plurality of longitudinally spaced and aligned holes 62, wherein one of the rows of the plurality of longitudinally spaced and aligned holes 62 through the lateral flap 32 may be adapted to selectively overlap the single row of the plurality of longitudinally spaced and aligned holes 62 through the medial flap 30, particularly the single primary row of plurality of longitudinally spaced and aligned holes 70. The amount of upward wrap and partial overlay of the lateral flap with the sole 20 may allow for and provide another adjustment of the shoe size of the adjustable shoe 10. Further, the amount of overlay of the medial flap 30 over the lateral flap 32 provides an additional adjustment of the shoe size of the adjustable shoe 10.

The integral toe cap 34 may extend from the toe end 22 of the sole 20 and may be adapted to wrap upwardly and partially over the sole 20 in the direction of the heel end 28, wherein the toe fastener 42 on the distal end 40 of the toe cap 34 may be adapted to extend through at least one of the plurality of longitudinally spaced and aligned holes 62 of one or both of the medial flap 30 and the lateral flap 32. As shown in the Figures, the toe fastener 42 on the distal end 40 of the toe cap 34 extends through one of the single primary row of plurality of longitudinally spaced and aligned holes 70 of the medial flap 30. The lower portion 66 of the toe fastener 42, shown in FIGS. 11A and 11B, when assembled with the upper portion 68 of the toe fastener 42 to attach the toe cap 34 to the medial flap 30, is thus disposed between the medial flap 30 and the lateral flap 32, thereby preventing the lower portion 66 of the toe fastener 42 from contact with the wearer's foot and preventing discomfort therefrom. The amount of upward wrap and partial overlay with the sole 20 may allow for and provide yet another adjustment of the shoe size of the adjustable shoe 10.

The pair of connecting straps 36 may be disposed on the medial flap 30 and a pair of flap buckles 44 may be disposed on the lateral flap 32, wherein the pair of connecting straps 36 may each further comprise a plurality of longitudinally spaced and aligned holes 46 within which the prong 48 of one of the flap buckles 44 may be selectively inserted to adjustably secure the connecting straps 36 to the lateral flap 32 and thereby adjustably secure the medial flap 30 and lateral flap 32 one to the other. The selection of one of the plurality of longitudinally spaced and aligned holes 46 through the connecting straps 36 for receiving the prong 48 of the flap buckle 44 may allow for and provide still another adjustment of the shoe size of the adjustable shoe 10.

Finally, the adjustable heel strap 38 may be connected to the medial flap 30 and the lateral flap 32 and extend around the heel end 28 of the sole 20. The button fastener 50 may extend through the adjustable heel strap 38 at a first end 52 thereof through which the button fastener 50, as shown in FIGS. 11A and 11B, may attach the adjustable heel strap 38 to one of the lateral flap 30 or medial flap 32. A plurality of longitudinally spaced and aligned holes 58 at a distal end 56 of the heel strap 38 may be provided within which the prong 60 of the heel buckle 54 disposed on the other of the medial flap 30 or the lateral flap 32 may be selectively inserted to adjustably secure the distal end 56 of the adjustable heel strap 38 to the other of the medial flap 30 or lateral flap 32, respectively. Both the button fastener 50 and the heel buckle may be rotatably mounted one of the medial flap 30 and/or the lateral flap 32, so as to allow the heel strap 38 to be positioned and stay secured at the back of the heel or so as to allow the heel strap 38 to pivot upward and forward over the medial flap 30 and lateral flap 32, thereby allowing a "slip-on mode" for the shoe 10. The selection of one of the plurality of longitudinally spaced and aligned holes 58 through the adjustable heel strap 38 for receiving the prong 60 of the heel buckle 54 may allow for and provide yet a further adjustment of the shoe size of the adjustable shoe 10.

In accordance with the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the terms "coupled" (in all of its forms, couple, coupling, coupled, etc.) and "connected" (in all of its forms, connect, connecting, connected, etc.) generally mean the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "operably connected" generally means that one component functions with respect to another component, even if there are other components located between the first and second component, and the term "operable" defines a functional relationship between components.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the inner faces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

The invention claimed is as follow:

1. An article of footwear comprising:

a sole having a toe end, a medial side, a lateral side, and a heel end;

a medial flap extending from the medial side of the sole and adapted to wrap upwardly and at least partially over the sole in the direction of the lateral side;

a lateral flap extending from the lateral side of the sole and adapted to wrap upwardly and at least partially over the sole in the direction of the medial side;

a toe cap extending from the toe end of the sole and adapted to wrap upwardly and partially over the sole in the direction of the heel end;

a connecting strap disposed on the medial flap or the lateral flap and adjustably connected to the other of the lateral flap or the medial flap, respectively; and an adjustable heel strap connected to the medial flap and the lateral flap and extending around the heel end of the sole;

wherein one of the medial flap or the lateral flap is adapted to overlap the other of the lateral flap or the medial flap, respectively, and the toe cap is adjustably connected at a distal end thereof to one or both of the medial flap and/or the lateral flap;

wherein the toe cap is adjustably connected to one or both of the medial flap and/or the lateral flap by a toe fastener; and wherein one or both of the medial flap and/or the lateral flap includes a plurality of longitudinally spaced and aligned holes and the toe fastener is adapted to extend through a mounting hole disposed on the distal end of the toe cap and is adapted to engage with at least one of the plurality of longitudinally spaced and aligned holes through one or both of the medial flap and/or the lateral flap.

2. The article of footwear of claim 1, wherein the sole, the medial flap, the lateral flap, and the toe cap are fabricated as a unitary structure.

3. The article of footwear of claim 2, wherein the sole, the medial flap, the lateral flap, and the toe cap is injection molded and comprise a polymeric material.

4. The article of footwear of claim 1, wherein the connecting strap disposed on a one of the medial flap or the lateral flap is adjustably connected to the other of the lateral flap or the medial flap, respectively, with a fastening device.

5. The article of footwear of claim 4, wherein the fastening device comprises a flap buckle mounted to the other of the lateral flap or medial flap.

6. The article of footwear of claim 5, wherein the connecting strap further comprises a plurality of longitudinally spaced and aligned holes within which a prong of the flap buckle may be selectively inserted to adjustably secure the connecting strap to the other of the lateral flap or medial flap and thereby adjustably secure the one of the medial flap or the lateral flap to the other of the lateral flap or medial flap, respectively.

7. The article of footwear of claim 6, further comprising a pair of connecting straps disposed on the one of the medial flap or the lateral flap and a pair of flap buckles disposed on the other of the lateral flap or medial flap, respectively, wherein the pair of connecting straps is each adjustably connected to the other of the lateral flap or the medial flap, respectively, with one of the pair of flap buckles.

8. The article of footwear of claim 1, further comprising a first fastener disposed on one of the lateral flap or the medial flap to which a proximal end of the heel strap is secured and a second fastener on the other of the medial flap or lateral flap to which a distal end of the heel strap is adjustably secured.

9. The article of footwear of claim 8, wherein:

the second fastener on the other of the medial flap or lateral flap comprises a heel buckle; and the heel strap further comprises a plurality of longitudinally spaced and aligned holes within which a prong of the heel buckle may be selectively inserted to adjustably secure the distal end of the heel strap to the other of the medial flap or lateral flap.

10. The article of footwear of claim 1, wherein the one of the medial flap or the lateral flap further includes a plurality of rows of the plurality of longitudinally spaced and aligned holes that are adapted to selectively overlap a corresponding one row of the plurality of longitudinally spaced and aligned holes through the other of the lateral flap or medial flap, and the toe fastener is adapted to extend through at least one of the plurality of longitudinally spaced and aligned holes through each of the medial flap and the lateral flap.

11. The article of footwear of claim 1 wherein the sole includes an outsole.

12. The article of footwear of claim 11 wherein the outsole extends onto the medial flap, the lateral flap, and the toe cap.

13. An article of footwear comprising:

a sole having a toe end, a medial side, a lateral side, and heel end;

a medial flap, a lateral flap, and a toe cap each disposed as integral extensions of the sole, the toe cap having a distal end with a fastener mounting hole;

a plurality of longitudinally spaced and aligned holes through each of the medial flap and the lateral flap, wherein the plurality of longitudinally spaced and aligned holes through the medial flap or the lateral flap are adapted to selectively overlap a corresponding plurality of longitudinally spaced and aligned holes through the other of the lateral flap or medial flap, respectively, and a toe fastener on a distal end of the toe cap is adapted to extend through at least one of the plurality of longitudinally spaced and aligned holes of one or both of the medial flap and the lateral flap;

a plurality of connecting straps adjustably connecting the medial flap with the lateral flap; and an adjustable heel strap adjustably connected to the medial flap and the lateral flap and extending around the heel end of the sole.

14. The article of footwear of claim 13, further comprising a plurality of rows of the plurality of longitudinally spaced and aligned holes through the medial flap or a plurality of rows of the plurality of longitudinally spaced and aligned holes through the lateral flap;

wherein a one row of the plurality of rows of the plurality of longitudinally spaced and aligned holes through one of the medial flap or the lateral flap are adapted to selectively overlap a corresponding plurality of longitudinally spaced and aligned holes through the other of the lateral flap or medial flap.

15. The article of footwear of claim 13, wherein the plurality of connecting straps further comprise a pair of connecting straps disposed on the medial flap or the lateral flap and the article of footwear further comprises a pair of flap buckles disposed on the other of the lateral flap or medial flap, respectively, wherein the pair of connecting straps is each adjustably connected to the other of the lateral flap or the medial flap, respectively, with one of the pair of flap buckles.

16. The article of footwear of claim 15, wherein the pair of connecting straps each further comprises a plurality of longitudinally spaced and aligned holes within which a prong of one of the pair of flap buckles may be selectively inserted to adjustably secure the pair of connecting straps to the other of the lateral flap or medial flap and thereby adjustably secure the medial flap or the lateral flap to the other of the lateral flap or medial flap, respectively.

17. The article of footwear as in claim 13 wherein the sole includes an outsole that extends onto the medial flap, the lateral flap, and the toe cap.

18. An article of footwear comprising:

a sole having a toe end, a medial side, a lateral side, and a heel end;

an integral medial flap extending from the medial side of the sole and adapted to wrap upwardly and at least partially over the sole in the direction of the lateral side, the medial flap having a plurality of longitudinally spaced and aligned holes, including a single primary row of plurality of longitudinally spaced and aligned holes;

an integral lateral flap extending from the lateral side of the sole and adapted to wrap upwardly and at least partially over the sole in the direction of the medial side, the lateral flap having a plurality of rows of a plurality of longitudinally spaced and aligned holes, wherein one of the rows of the plurality of longitudinally spaced and aligned holes through the lateral flap is adapted to selectively overlap the plurality of longitudinally spaced and aligned holes through the medial flap;

an integral toe cap extending from the toe end of the sole and adapted to wrap upwardly and partially over the sole in the direction of the heel end, wherein a toe fastener on the distal end of the toe cap is adapted to extend through at least one of the single primary row of plurality of longitudinally spaced and aligned holes of the medial flap and/or at least one of the plurality of longitudinally spaced and aligned holes of one or both of the medial flap and the lateral flap;

a pair of connecting straps disposed on the medial flap and a pair of flap buckles disposed on the lateral flap, wherein the pair of connecting straps each further comprises a plurality of longitudinally spaced and aligned holes within which a prong of one of the flap buckles may be selectively inserted to adjustably secure the connecting straps to the lateral flap and thereby adjustably secure the medial flap and lateral flap one to the other; and an adjustable heel strap connected to the medial flap and the lateral flap and extending around the heel end of the sole, wherein the adjustable heel strap further comprises a mounting hole at a first end through which a fastener extends to attach the adjustable heel strap to one of the lateral flap or medial flap and a plurality of longitudinally spaced and aligned holes at a second end thereof within which a prong of a heel buckle disposed on the other of the medial flap or the lateral flap may be selectively inserted to adjustably secure the second end of the adjustable heel strap to the other of the medial flap or lateral flap.

* * * * *